United States Patent [19]

Golston et al.

[11] Patent Number: 4,936,062

[45] Date of Patent: Jun. 26, 1990

[54] REBAR TIE HOLDER

[76] Inventors: S. Webb Golston, 1913 Marshall Rd., Denton, Tex. 76201; Joe R. Golston, 8412 Hopewell, El Paso, Tex. 79925; Robert S. Welch, 2716 Savannah, El Paso, Tex. 79930

[21] Appl. No.: 391,196

[22] Filed: Aug. 9, 1989

[51] Int. Cl.[5] ..... E02D 35/00

[52] U.S. Cl. ..... 52/127.1; 52/432; 52/712; 52/741

[58] Field of Search ..... 52/431, 432, 438, 442, 52/712, 698, 127.1, 741

[56] References Cited

U.S. PATENT DOCUMENTS

| | | | |
|---|---|---|---|
| 1,717,546 | 6/1929 | Bemis . | |
| 2,315,634 | 4/1943 | McCall | 25/128 |
| 2,453,466 | 11/1948 | Slobodzian | 72/15 |
| 3,686,817 | 8/1972 | Adams | 52/586 |
| 4,033,534 | 7/1977 | Bergkvist | 248/49 |
| 4,107,895 | 8/1978 | LeGrady | 52/687 |
| 4,190,999 | 3/1980 | Hampton | 52/442 X |
| 4,337,605 | 7/1982 | Tudek | 52/293 |

*Primary Examiner*—Carl D. Friedman

*Attorney, Agent, or Firm*—Richards, Medlock & Andrews

[57] ABSTRACT

An apparatus (26) is disclosed which assists in tying a foundation reinforcing bar (18) to a reinforcing bar (24) extending through a wall of cinder blocks (12) after the wall has been constructed. The apparatus includes a low cost carrier (28) which is placed atop a block as the wall is constructed at the position where the reinforcing bars are to be tied together. The carrier carries a cable tie (40) in an open loop with the ends of the tie extending out of the wall. When the reinforcing bars are to be tied together, the ends of the cable tie are simply pulled to disengage the tie from the carrier and closed the loop about the reinforcing bars. Cement is then poured into the open cells of the wall and around the reinforcing bar. The exposed ends of the cable tie can be simply cut off and mortar used to fill the small hole through which they pass.

7 Claims, 3 Drawing Sheets

REBAR TIE HOLDER

TECHNICAL FIELD

This invention relates to the construction industry, and particularly to Concrete Masonry Unit (C.M.U.) construction where a structure is formed of open cell blocks secured together with reinforcing bars and grout in the cells.

BACKGROUND OF THE INVENTION

Concrete Masonry Unit (C.M.U.) construction is a common method for building walls in homes, businesses and the like. The common block (cinder, slump or other) is a rectangular concrete block having two openings or cells formed through the block. The blocks are stacked one on top of the other with mortar placed between the blocks.

When the wall has been constructed, the cells of the blocks in the wall form a complex matrix which can be filled with concrete grout to enhance the strength of the wall. An even stronger construction is possible if reinforcing bar, typically steel, extends vertically through the wall through the cells to cooperate with the concrete.

In a typical reinforced construction, the foundation will be laid with reinforcing bars extending vertically upward from the foundation two feet or so at uniform distances around the foundation. The wall is built up with the blocks on the foundation, and when the final height of the wall has been reached, a second reinforcing bar is inserted from the top of the wall through the various interconnecting cells until that bar hits the foundation proximate one of the foundation reinforcing bars. It is then necessary to tie those two bars together as a pair just prior to filling the cells with concrete to ensure that the inserted bar is vertical and maximize the final strength of the wall.

However, as the wall is typically built to its final height prior to inserting the reinforcing bar, and the foundation reinforcing bar is relatively short and near the foundation itself, a difficulty arises as how to tie the two reinforcing bars together inside the wall. A common solution to that problem is for a construction worker to simply knock a hole through the wall of the cinder block at a position where the two bars pass one another to allow the construction worker to tie the bars together. Sometimes, the hole is cut in the block prior to its placement in the wall. Of course, whenever made, the holes must be repaired after the bars are tied.

Another common method is to tie the reinforcing bar together prior to erecting the wall. The block is then lowered into place over the bar, most times requiring two or more men and scaffolding. This is the only method presently acceptable when erecting a wall using architectural block, i.e. block with both faces exposed as finished product, where a hole knocked or cut in the wall is unacceptable.

Therefore, a need exists for an improved apparatus and method for installing reinforcing bar to overcome the aforementioned disadvantages.

SUMMARY OF THE INVENTION

In accordance with one aspect of the present invention, an apparatus is provided to assist tying together a pair of reinforcing bars within a cell of a block. The apparatus includes a carrier having a substantially continuous perimeter defining a notch. A cable tie, having first and second ends, is positioned in the notch and forms a loop. The carrier is positioned on the block with the pair of reinforcing bars to be joined passing through the loop of the cable tie. The cable tie is subsequently disengaged from the carrier to secure the pair of reinforcing bars together.

In accordance with another aspect of the present invention, a method is disclosed to assist in tying together a pair of reinforcing bars within a cell of a block. The method includes the steps of positioning a carrier on the block, the carrier having a substantially continuous perimeter defining a notch with a cable tie having first and second ends positioned in the notch and forming a loop. The carrier is positioned so that the first and second ends of the cable tie extend outward from the block. The method includes the step of drawing on the first and second ends of the cable tie to disengage the cable tie from the carrier and tie the reinforcing bars together.

BRIEF DESCRIPTION OF THE DRAWINGS

Further objects and advantages of the invention will become more apparent from the following description, claims and from the accompanying drawings, wherein:

DETAILED DESCRIPTION

Figure 1:
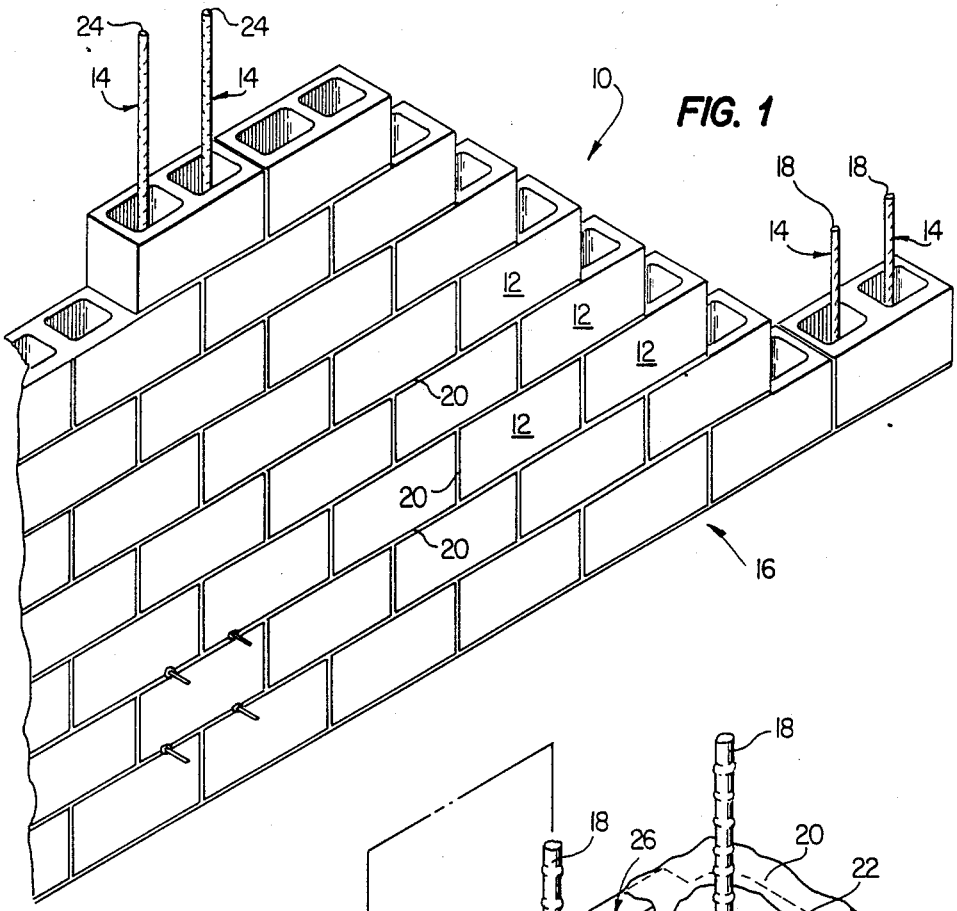
FIG. 1 is a perspective view of a typical cinder block wall in which the advantages of the present invention utilized.

With reference to the accompanying Figures, wherein like reference numerals designate like or corresponding parts throughout the several views, the present invention is explained hereinafter.

Figure 2:
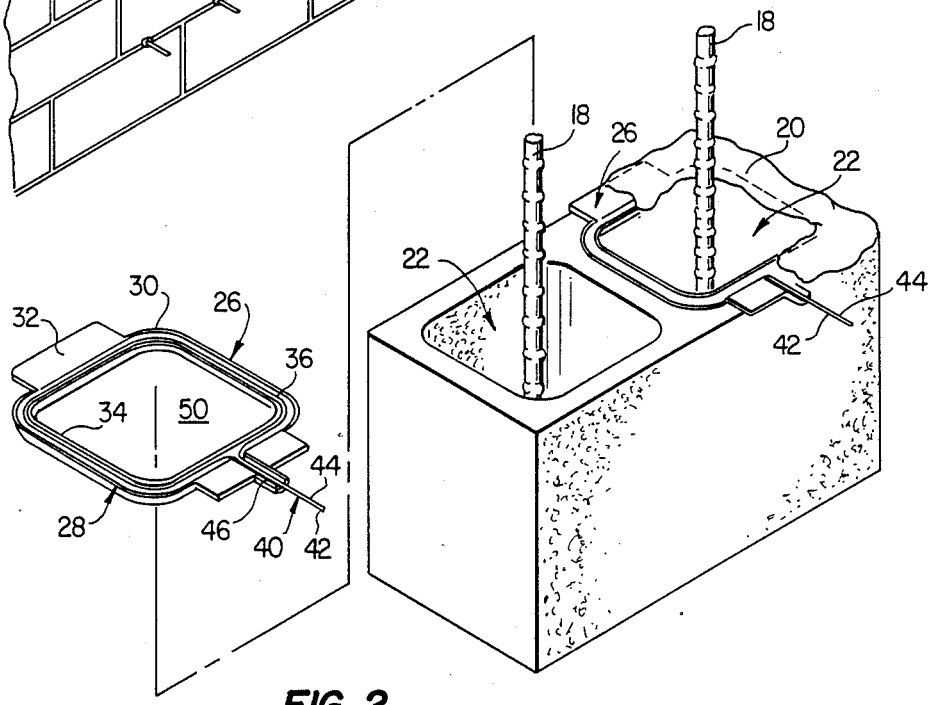
FIG. 2 is a perspective view of a cinder block showing the installation of an apparatus forming a first embodiment of the present invention.
Figure 5:
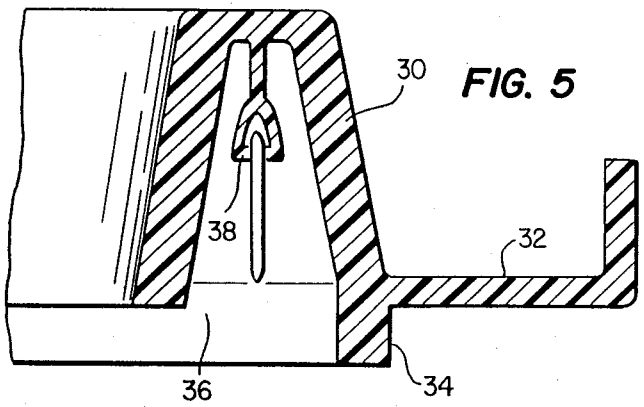
FIG. 5 is an exploded vertical cross section of a portion of the apparatus of FIG. 3.

As seen in FIGS. 1 and 2, the advantages of the present invention can be best employed in the construction of a wall 10 which includes the use of cinder blocks 12 and reinforcing bar 14.

In a typical construction, a foundation 16 will be laid around the perimeter of the house, building or line of wall to be built. Extending vertically out of the foundation, at spaced intervals around the foundation, are short sections of reinforcing bar 14 illustrated as bars 18. Bars 18 may extend two or three feet above the foundation, for example.

The wall is then constructed by laying courses of blocks 12 as illustrated. Mortar 20 is applied between each of the blocks. As seen in the Figures, the blocks 12 illustrated are of the type having two vertically extending cells 22 therethrough which allow for the eventual pouring of concrete into the various interconnecting cells of the wall to enhance the strength of the wall.

When the wall has been built to the height desired, wall reinforcing bars 14, illustrated as bars 24, are cut to the proper length and inserted from the top of the wall through the various interconnecting cells of the blocks to contact the foundation 16 proximate a bar 18. It is then required by most or all existing building codes to tie the bars 18 and 24 together so that they will be embedded in the concrete side by side to maximize the strength of the wall. It is important to understand that the tie is not meant to be significantly strong in and of itself, but simply to position the two bars next to each other so that the concrete can lock them together.

An apparatus 26, shown in FIGS. 2–6, forms a first embodiment of the present invention. It includes a carrier 28 with a continuous rim 30, anchoring fins 32 and positioning fins 34. The fins 32 of the apparatus 26 in FIG. 2 differs slightly from the fins 32 of apparatus 26 in FIGS. 3–6 to show that a multitude of fin configurations are possible. A downwardly facing continuous notch 36 is formed in rim 30 which has clips 38 distributed along the notch. (The apparatus 26 on the left side of FIG. 2 is illustrated upside down for ease in viewing the notch 36). A cable tie 40 is secured to the clips 38 within the notch 36 to form a loop. The ends 42 and 44 of the cable tie extend along a branch 46 of the notch and extend from the carrier 28. Branch 46 in the apparatus 26 of FIG. 2 is part of fin 32, while branch 46 in the apparatus 26 is simply an aperture through the outer wall of rim 30, again to show that a multitude of configurations are possible.

As can best be seen in FIGS. 2–6, the apparatus 26 is laid atop a block 12 at a position where the bars 18 and 24 are to be tied. The positioning fins 34 contact the inner wall 48 of the cell to position the apparatus 26 relative to the cell with the ends 42 and 44 of the cable tie extending out from the top of the block. In this position, the downwardly facing notch 36 opens into the cell 22. Mortar 20 is spread along the top of the cinder block 12 and the next courses of blocks installed in the usual manner. The anchoring fins 32 interlock with the mortar and blocks to securely fix the apparatus 26 in place.

Figure 6:
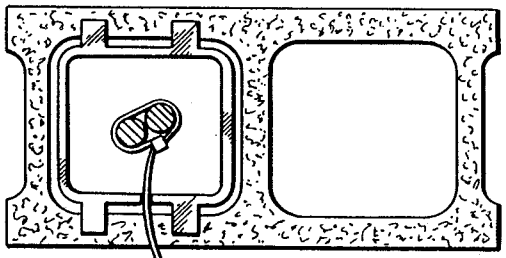
FIG. 6 is a plan view of the apparatus of FIG. 3 having a pair of reinforcing bars together.
Figure 3:
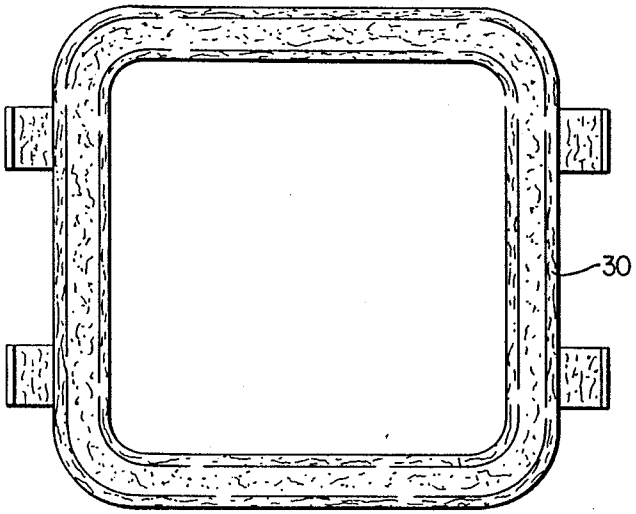
FIG. 3 is a top view of the apparatus with slight modification.
Figure 4:
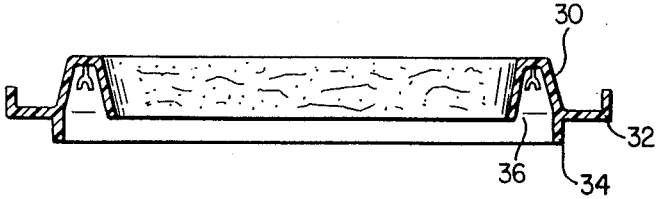
FIG. 4 is a vertical cross sectional view of the apparatus of FIG. 3.

After the wall has been built to the proper height, the bar 24 is inserted into the wall to contact the foundation 16. The opening 50 through the carrier 28 and cable tie 40 is designed to be almost the same cross section as the cell through which the bar 24 passes. Therefore, there will be no difficulty in inserting the bar 24 through the proper cell. To tie the pair of bars together, all that must be done is to pull on the ends 42 and 44 from outside the wall, which pulls the cable tie 40 off of the clips 38, out of the notch 36, and around the bars 18 and 24 to tie them together, as best seen in FIG. 6. Concrete can then be poured into the cells of the blocks to secure the bars in place. The excess length of ends 42 and 44 extending from the wall can be cut off and the little aperture remaining sealed off with fresh mortar, if desired. The apparatus, being relatively inexpensive, is simply left within the wall permanently where it has no detrimental effect on the strength of the wall.

To minimize cost, the carrier 28 is preferably formed of an injection molded plastic. However, carrier 28 can be formed of any inorganic material, such as stamped or cast metals. Likewise, cost considerations are important to selection of the material for cable tie 40. The cable tie can be made of nylon, wire, or a metal strap, for example. The wire could be extruded, twisted or braided. The metal strap could be made of spring steel.

Figure 7A:
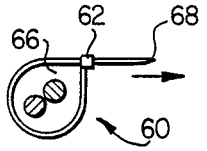
FIGS. 7A–G illustrate schematically various tying techniques that can be employed in the present invention.

FIGS. 7A–G illustrate various alternative cable tie constructions. FIG. 7A discloses a standard cable tie 60, made of nylon or other plastic, which has a one-way ratchet mechanism 62 which interacts with notches formed in the tie so that the loop 66 in the tie can only decrease as end 68 is pulled relative to the mechanism 62, which is positioned at the other end of the tie.

Figure 7B:
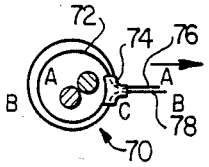
Figure 7C:
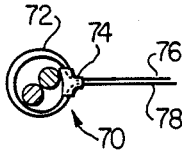

FIGS. 7B and C illustrate a tie 70 which uses a double loop of cable or string 72 and a yoke 74 which holds the cable 72 tight around the reinforcing bar when the ends 76 and 78 of the tie are pulled relative to the yoke.

Figure 7D:
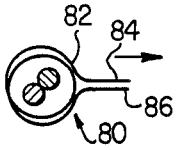

FIG. 7D illustrates a tie 80 formed of a double loop of wire 82 where pulling on the ends 84 and 86 will tighten the wire about the reinforcing bars.

Figure 7E:
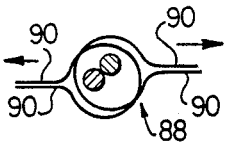

FIG. 7E illustrates a double wire tie 88 which requires the ends 90 of the wires to extend out opposite sides of the wall to be pulled simultaneously from both sides at once.

Figure 7F:
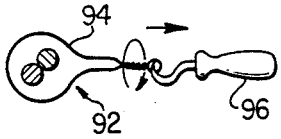

FIG. 7F illustrates a tie 92 which is formed of wire 94, the ends of which can be pulled and twisted with a tool 96 to tie the reinforcing bars together.

Figure 7G:
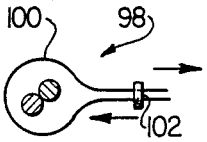

FIG. 7G illustrates a tie 98 having a wire 100 and a sliding yoke 102 which sits within the cell. Pulling on the ends of the wire 100 while sliding the yoke toward the reinforcing bars inside the cell with a tool, such as a rod, will secure the reinforcing bar together as well.

Usually, two closely spaced apparatus 26 will be used to tie each pair of reinforcing bar together, such as seen in FIG. 1, with only one or two courses of blocks between the apparatus. The object is to tie the reinforcing bars together as near the center of the particular cell as possible. This is readily achieved using the advantages of the present invention. The reinforcing bars 24 will commonly extend above the top of the wall of cinder blocks 12 to be molded into a bond beam poured along the top of the wall. In other situations, the bar 24 may be cut off just short of the top of the wall. In any event, the advantages of the present invention can be employed to secure the bars 18 and 24 together.

Figure 8:
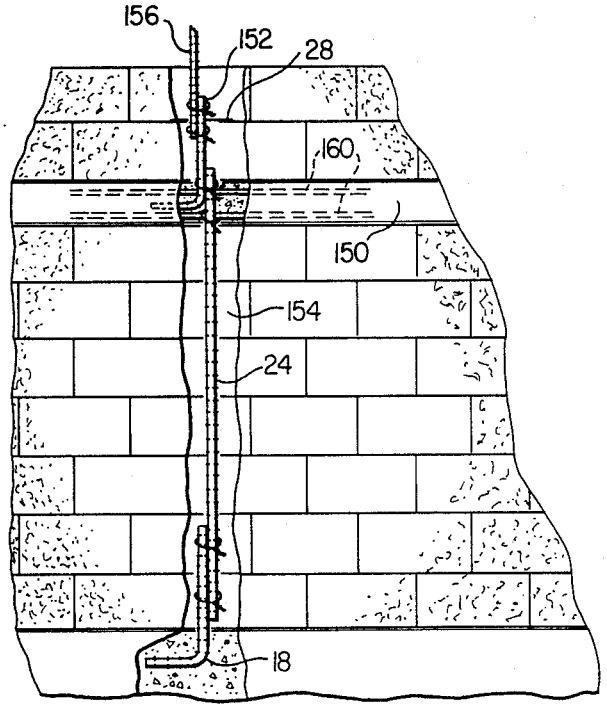
FIG. 8 is an illustrative view of the apparatus used at an intermediate level in a multi-section wall.

The advantages of the present invention can also be used, in a similar fashion to that described previously, above an intermediate bond beam 150, as illustrated in FIG. 8. Usually, a series of horizontal bond bars 160 will be part of beam 150, and will be tied into the bars 24 to add strength. A short bar 152 can be set in place as illustrated to extend above the bond beam 150. The lower section 154 of the wall can be grouted to seal in place the bars 18, 24 and 160, and part of bar 152. An upper section can then be built up from beam 150. A carrier 28 can be placed on top of beam 150, with the upper section built up from there to tie the vertical bars 156 in the upper section to bar 152.

Although a single embodiment of the invention has been illustrated in the accompanying drawings and described in the foregoing Detailed Description, it will be understood that the invention is not limited to the embodiment disclosed, but is capable of numerous of rearrangements, modifications and substitutions of parts and elements without departing from the spirit and scope of the invention.

We claim:

1. An apparatus to assist tying together a pair of reinforcing bars within a cell of a block, comprising:

a carrier having a substantially continuous perimeter defining a notch;

a cable tie, having first and second ends, positioned in the notch and forming a loop; and the carrier positioned on the block with the pair of reinforcing bars to be joined passing through the loop of the cable tie so that the cable tie can be disengaged from the carrier to secure the pair of reinforcing bars together.

2. The apparatus of claim 1 wherein the carrier includes clips in the notch to hold the cable tie positioned in the notch.

3. The apparatus of claim 1 wherein the carrier further comprises at least one positioning fin to position the carrier relative to the cell in the block so that the loop approximately overlaps the cell and the carrier remains in position as other blocks are laid.

4. The apparatus of claim 1 wherein the carrier further comprises at least one anchoring fin to anchor the carrier on the block with mortar.

5. The apparatus of claim 1 wherein the carrier is formed of an injection molded plastic.

6. A method for tying together a pair of reinforcing bars within a cell of a block in a wall, comprising the steps of:

forming a carrier having a substantially continuous perimeter and defining a notch;

mounting a cable tie in the notch of the carrier to form a loop with the ends of the cable tie extending from the carrier so that pulling on the ends of the cable tie will draw the cable tie out of the notch to close the loop.

7. A method to assist tying together a pair of reinforcing bars within a cell of a block in a wall, comprising the steps of:

positioning a carrier on top of the block about the cell, the carrier having a substantially continuous perimeter defining a notch, a cable tie secured in the notch and forming a loop;

laying at least one course of additional blocks to permanently secure the carrier between the blocks;

drawing the ends of a cable tie positioned in the notch of the carrier from outside the wall to tie together the pair of reinforcing bars.

* * * * *